US009523297B2

(12) United States Patent
Kitagawa

(10) Patent No.: US 9,523,297 B2
(45) Date of Patent: Dec. 20, 2016

(54) ENGINE APPARATUS WITH BLOW-BY GAS HANDLING DEVICE

(71) Applicant: YANMAR CO., LTD., Osaka (JP)

(72) Inventor: Tomoaki Kitagawa, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 14/372,535

(22) PCT Filed: Jan. 11, 2013

(86) PCT No.: PCT/JP2013/050453

§ 371 (c)(1),
(2) Date: Jul. 16, 2014

(87) PCT Pub. No.: WO2013/108723

PCT Pub. Date: Jul. 25, 2013

(65) Prior Publication Data

US 2014/0366855 A1 Dec. 18, 2014

(30) Foreign Application Priority Data

Jan. 19, 2012 (JP) ..... 2012-008949

(51) Int. Cl.
*F01M 13/00* (2006.01)
*F01M 13/04* (2006.01)

(52) U.S. Cl.
CPC ..... *F01M 13/00* (2013.01); *F01M 13/0416* (2013.01); *F01M 2013/005* (2013.01);
(Continued)

(58) Field of Classification Search
CPC .. F01M 13/00; F01M 13/04; F01M 2013/005; F01M 13/0033; F02M 35/10209
(Continued)

(56) References Cited

U.S. PATENT DOCUMENTS 4,541,399 A * 9/1985 Tanaka ..... F01M 13/023 123/572
4,667,647 A * 5/1987 Ohtaka ..... F01M 5/001 123/573

(Continued)

FOREIGN PATENT DOCUMENTS

DE 10 2006 041 213 3/2008
JP 3-89918 9/1991

(Continued)

OTHER PUBLICATIONS

JP2010216315A, Machine Translation of Detailed Description, Takaoka, K., Sep. 30, 2010, obtained from http://www.j-platpat.inpit.go.jp, pp. 1-8.*

(Continued)

*Primary Examiner* — Lindsay Low
*Assistant Examiner* — Grant Moubry
(74) *Attorney, Agent, or Firm* — Norris McLaughlin & Marcus, P.A.

(57) ABSTRACT

An engine apparatus that utilizes a gas pressure regulation valve not only for pressure adjustment but also for removal of lubricant. An engine apparatus includes a blow-by gas returning device to return a leakage of blow-by gas from a combustion chamber to an intake system. The engine apparatus includes an expansion chamber, into which the blow-by gas is introduced from the gas pressure regulation valve. In the expansion chamber, lubricant contained in the blow-by gas is isolated. The blow-by gas is returned to an intake side of an engine from the expansion chamber.

1 Claim, 16 Drawing Sheets

(52) U.S. Cl.
CPC ..... *F01M 2013/0016* (2013.01); *F01M 2013/0433* (2013.01); *F01M 2013/0461* (2013.01)

(58) Field of Classification Search
USPC ..... 123/572, 573, 574, 41.86
See application file for complete search history.

(56) References Cited

U.S. PATENT DOCUMENTS

| | | | | |
|---|---|---|---|---|
| 5,429,101 | A | 7/1995 | Uebelhoer et al. | |
| 6,021,766 | A * | 2/2000 | Maeda et al. | 123/573 |
| 6,439,215 | B1 * | 8/2002 | Sato et al. | 123/572 |
| 6,530,367 | B2 * | 3/2003 | Akiwa et al. | 123/572 |
| 6,591,820 | B2 * | 7/2003 | Kitano et al. | 123/572 |
| 6,868,843 | B2 * | 3/2005 | Yasui | 123/572 |
| 6,899,091 | B2 * | 5/2005 | Akiyama et al. | 123/572 |
| 7,025,049 | B2 * | 4/2006 | Pietschner | 123/572 |
| 7,594,501 | B2 | 9/2009 | Brand et al. | |
| 7,849,841 | B2 * | 12/2010 | Holzmann et al. | 123/572 |
| 8,082,907 | B2 * | 12/2011 | Huff | 123/572 |
| 8,137,424 | B2 * | 3/2012 | Ohzono | 55/385.3 |
| 8,161,951 | B2 * | 4/2012 | Mochida | 123/572 |
| 8,752,578 | B2 * | 6/2014 | Mincher et al. | 137/509 |
| 8,789,517 | B2 * | 7/2014 | Narita | 123/572 |
| 8,893,688 | B2 | 11/2014 | Ruppel et al. | |
| 8,978,631 | B2 * | 3/2015 | Shudo et al. | 123/572 |
| 2008/0149065 | A1 | 6/2008 | Brand et al. | |
| 2010/0006075 | A1 | 1/2010 | Ruppel et al. | |

FOREIGN PATENT DOCUMENTS

| | | |
|---|---|---|
| JP | 6-257419 | 9/1994 |
| JP | 11-141325 | 5/1999 |
| JP | 2003-090204 | 3/2003 |
| JP | 2008-169829 | 7/2008 |
| JP | 2008-175129 | 7/2008 |
| JP | 2009-133235 | 6/2009 |
| JP | 2010-501788 | 1/2010 |
| JP | 2010-216315 | 9/2010 |

OTHER PUBLICATIONS

JP2009133235A, Machine Translation of Detailed Description, Hashimoto, E., Jun. 18, 2009, obtained from http://www.j-platpat.inpit.go.jp, pp. 1-13.*

* cited by examiner

ENGINE APPARATUS WITH BLOW-BY GAS HANDLING DEVICE

TECHNICAL FIELD

The present invention relates to engine apparatuses such as diesel engines to be built in working vehicles such as skid steer loaders, backhoes, and forklift trucks, in agricultural machines such as tractors and combines, and in fixed electric generators or refrigerators. More specifically, the present invention relates to an engine apparatus provided with a blow-by gas returning device to return blow-by gas to an intake system.

BACKGROUND OF THE INVENTION

A conventional technique is to isolate lubricant from a leakage of blow-by gas from a combustion chamber and to return the blow-by gas without lubricant to the intake side (such as an intake manifold) of the engine (see, for example, patent document 1 and patent document 2).

Another conventional technique is to remove lubricant using chambers each incorporating a plurality of oil trap materials (filtration nets) (patent document 1). Still another conventional technique is to remove lubricant using a spiral member having a variable spiral pitch (patent document 2).

RELATED ART DOCUMENTS

Patent Documents

Patent document 1: Japanese Unexamined Patent Application Publication No. 2003-90204.

Patent document 2: Japanese Unexamined Patent Application Publication No. 2010-216315.

Patent documents 1 and 2 respectively require a plurality of oil trap materials (filtration nets) and a spiral member. Thus, there are problems in reducing the piece-part count of the blow-by gas returning device and in simplifying maintenance work of the blow-by gas returning device and other devices.

In view of the above-described circumstances, the present invention provides an improved engine apparatus.

SUMMARY OF THE INVENTION

According to the invention, an engine apparatus includes: a blow-by gas returning device configured to return a leakage of blow-by gas from a combustion chamber to an intake system; and an expansion chamber into which the blow-by gas is introduced through a gas pressure regulation valve, in which lubricant contained in the blow by gas is isolated, and from which the blow-by gas is returned to an intake side of an engine.

According to the invention, in the engine apparatus, the expansion chamber may include: a lubricant return hole through which the lubricant isolated in the expansion chamber is returned to an inside of the engine; and a plate spring including a non-return valve openable and closable over the lubricant return hole of the expansion chamber.

According to invention, in the engine apparatus a blow-by gas exit may be disposed adjacent to a center of a right-left width of a portion of a head cover where the expansion chamber is disposed so as to return the blow-by gas from the expansion chamber to the intake side of the engine through the blow-by gas exit.

Effects of the Invention

With the invention, in an engine apparatus including a blow-by gas returning device to return a leakage of blow-by gas from the combustion chamber to the intake system, an expansion chamber through which the blow-by gas is introduced through a gas pressure regulation valve is disposed. In the expansion chamber, lubricant contained in the blow-by gas is isolated. The blow-by gas is returned to the intake side of the engine from the expansion chamber. By introducing the blow-by gas into the expansion chamber through the gas pressure regulation valve, an intermittent, forceful stream of the blow-by gas passes through a narrow gap in the gas pressure regulation valve. This involves high speed collision of mist lubricant contained in the blow-by gas, thereby promoting the mist lubricant to liquefy. Thus, the mist lubricant contained in the blow-by gas liquefies in the expansion chamber and thus is removed. The gas pressure regulation valve is utilized not only for pressure adjustment but also for removal of lubricant, which eliminates the need for a filtration net. The blow-by gas returning structure is simplified in that it is not necessary to provide a mist separator. The consumption of engine lubricant is reduced, and this ensures that in an engine equipped with an exhaust gas purifier (diesel particulate filter), the exhaust gas purifier is less likely to suffer from catalyst degradation and clogging, resulting in improved fuel efficiency.

The invention is concerned with a structure provided with a lubricant return hole through which the lubricant isolated in the expansion chamber is returned to an inside of the engine. In this structure, a plate spring in the form of a non-return valve is openable and closable over the lubricant return hole of the expansion chamber. This facilitates the return of the lubricant collected in the expansion chamber to the engine side while preventing the lubricant from being injected from the engine side toward the expansion chamber. For example, the expansion chamber, which has a hermetically sealed structure, is readily provided on a head cover with reduced piece-part count.

The invention is concerned with a structure in which the blow-by gas is returned from the expansion chamber to the intake side of the engine through a blow-by gas exit. The blow-by gas exit is disposed adjacent to a center of a right-left width of a portion of a head cover where the expansion chamber is disposed. This ensures that the blow-by gas exit is any time kept at a distance from the surface of the lubricant isolated in the expansion chamber even when the engine is inclined in any of the left and right directions to increase the height of the surface of the lubricant. The lubricant collected in the expansion chamber is readily prevented from flowing into the blow-by gas exit.

DETAILED DESCRIPTION OF THE PREFERRED EMBODIMENTS

Figure 1:
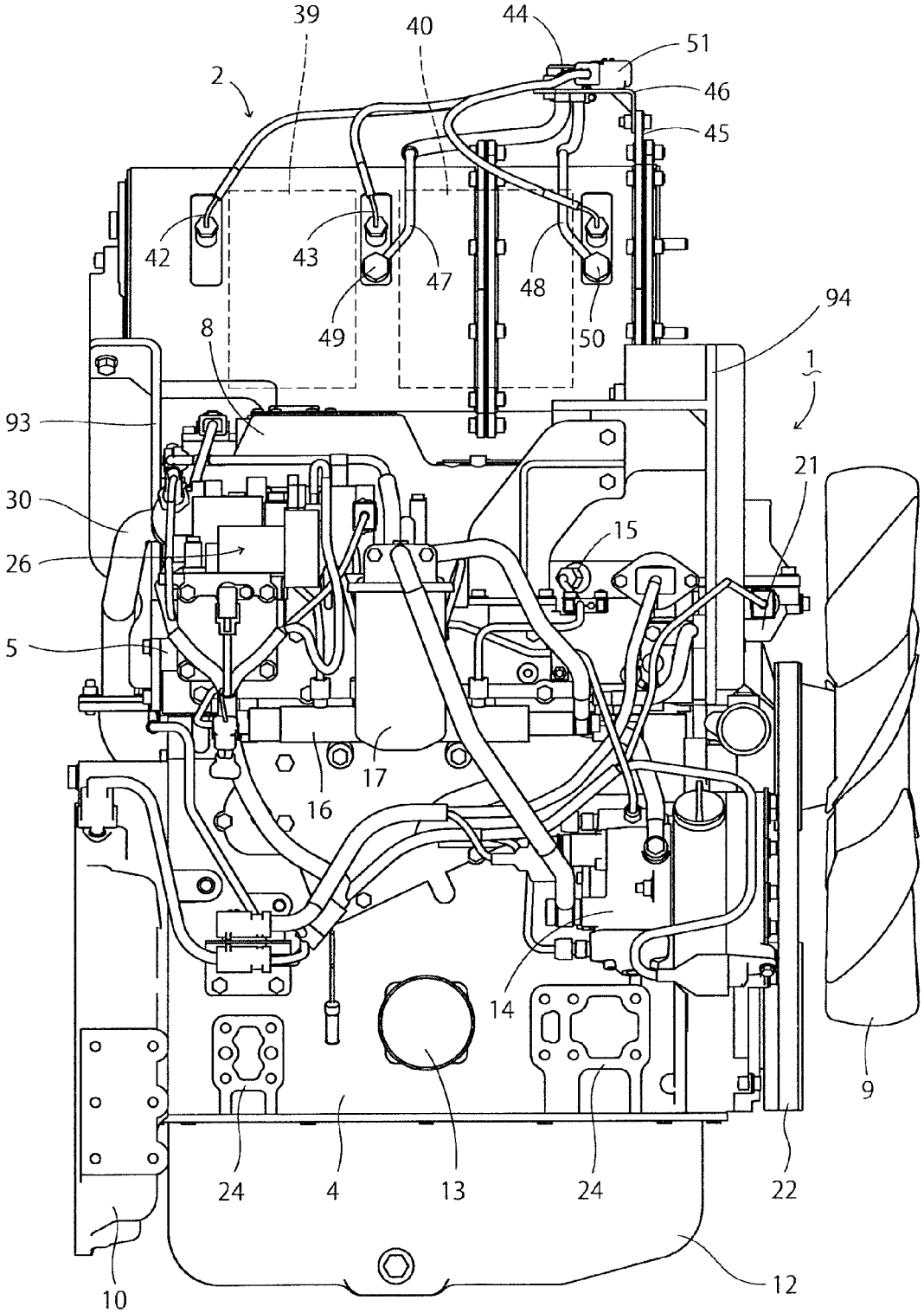
FIG. 1 is a front view of a diesel engine according to a first embodiment.
Figure 2:
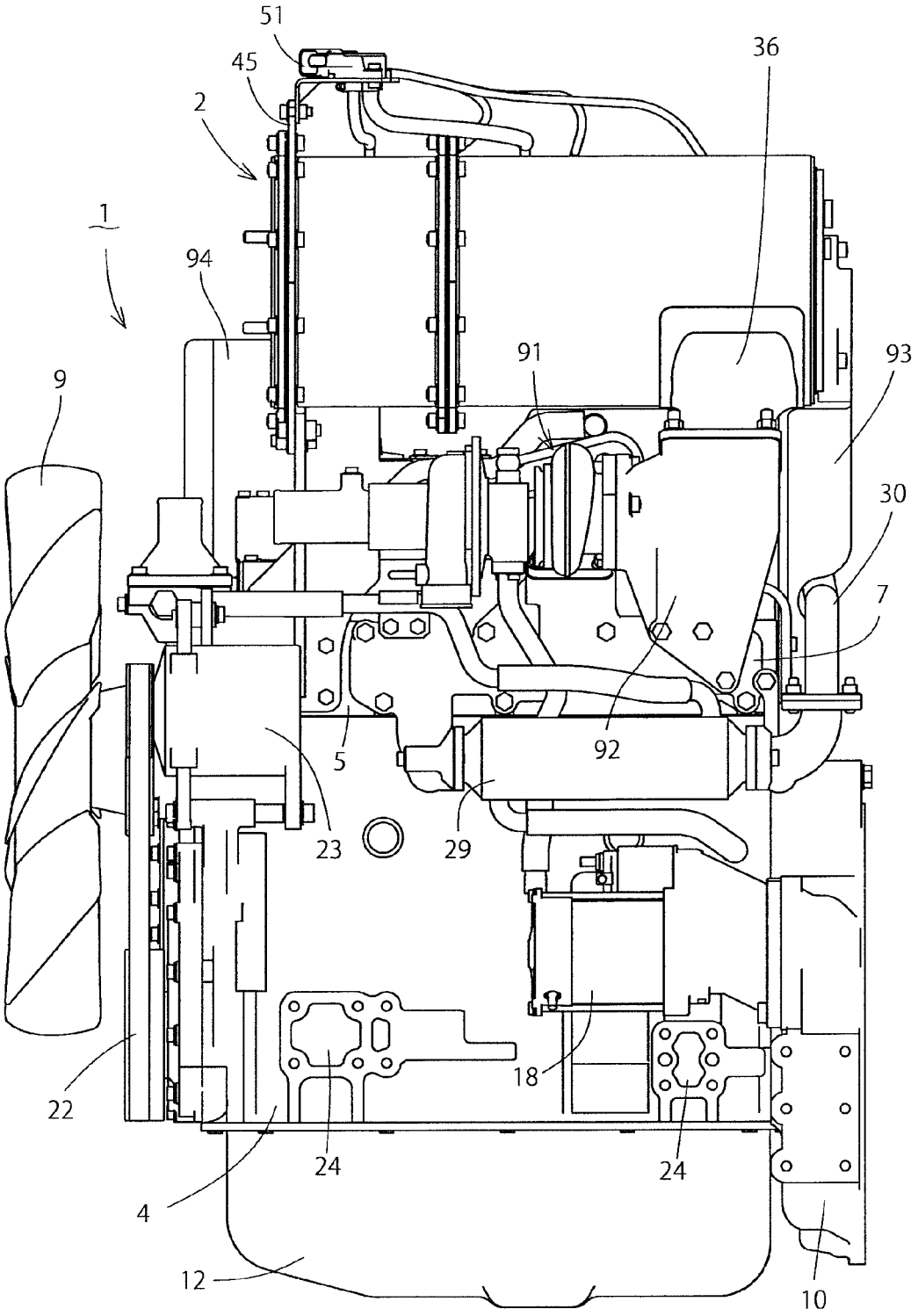
FIG. 2 is a rear view of the diesel engine.
Figure 3:
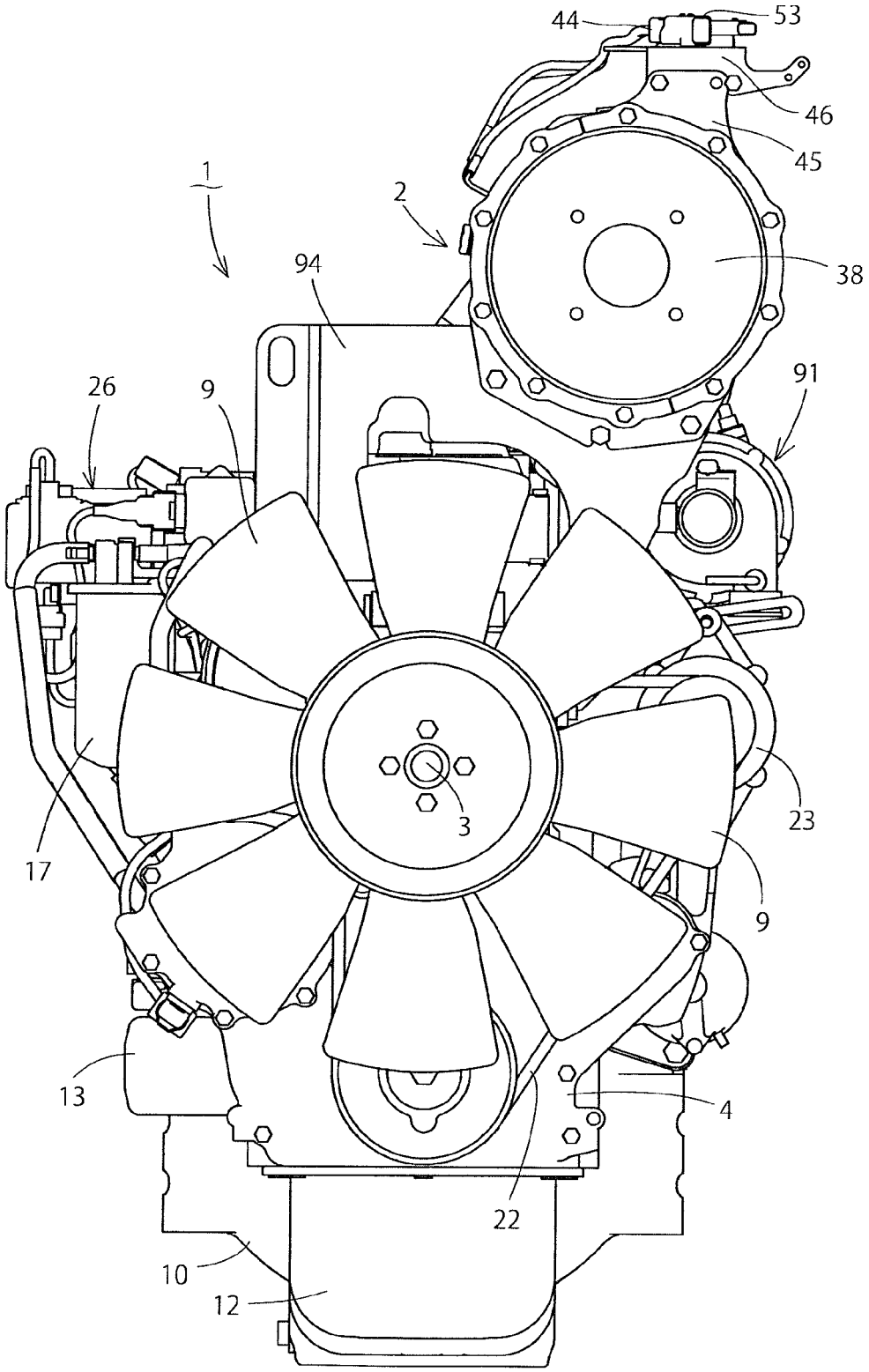
FIG. 3 is a right side view of the diesel engine.
Figure 4:
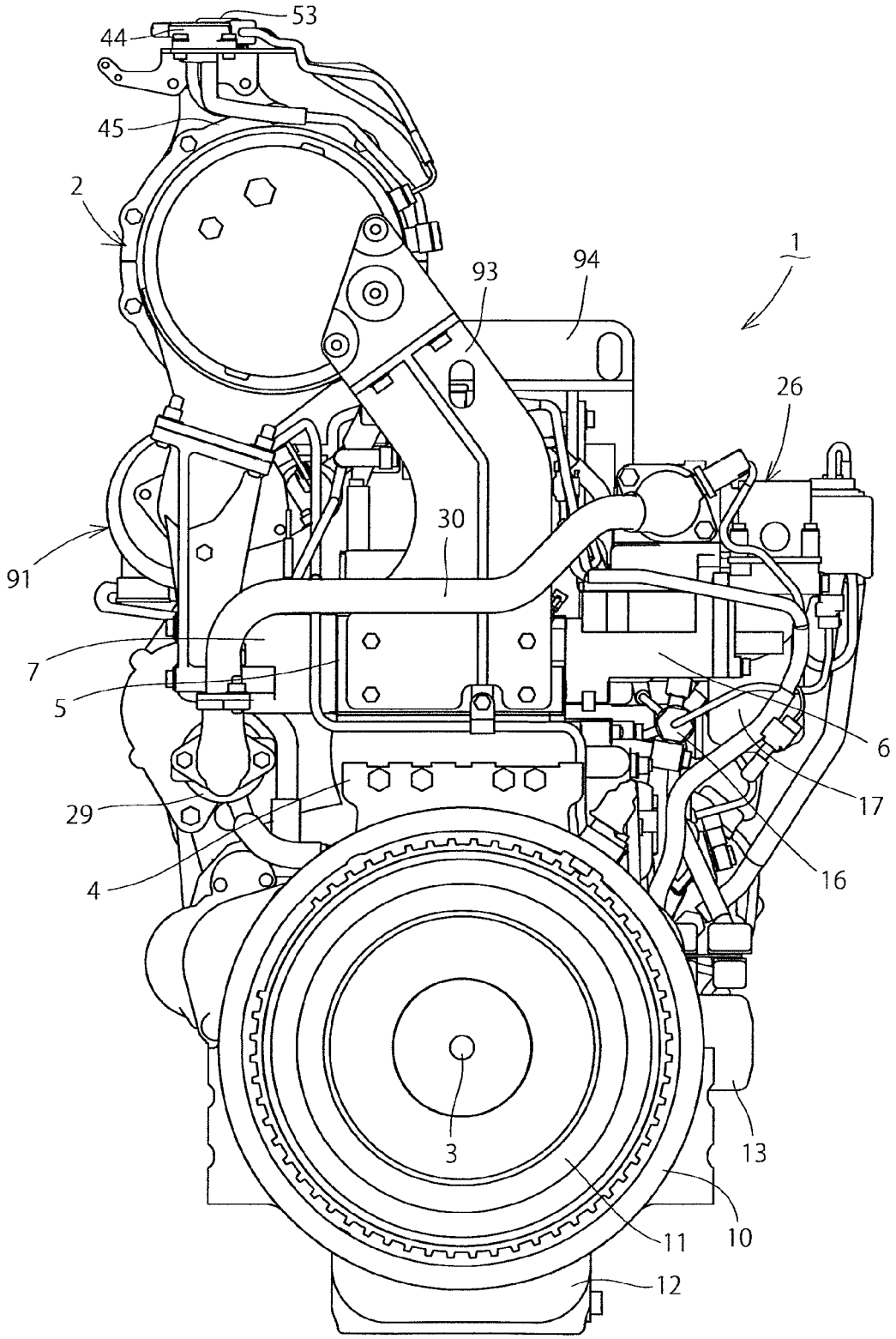
FIG. 4 is a left side view of the diesel engine.
Figure 5:
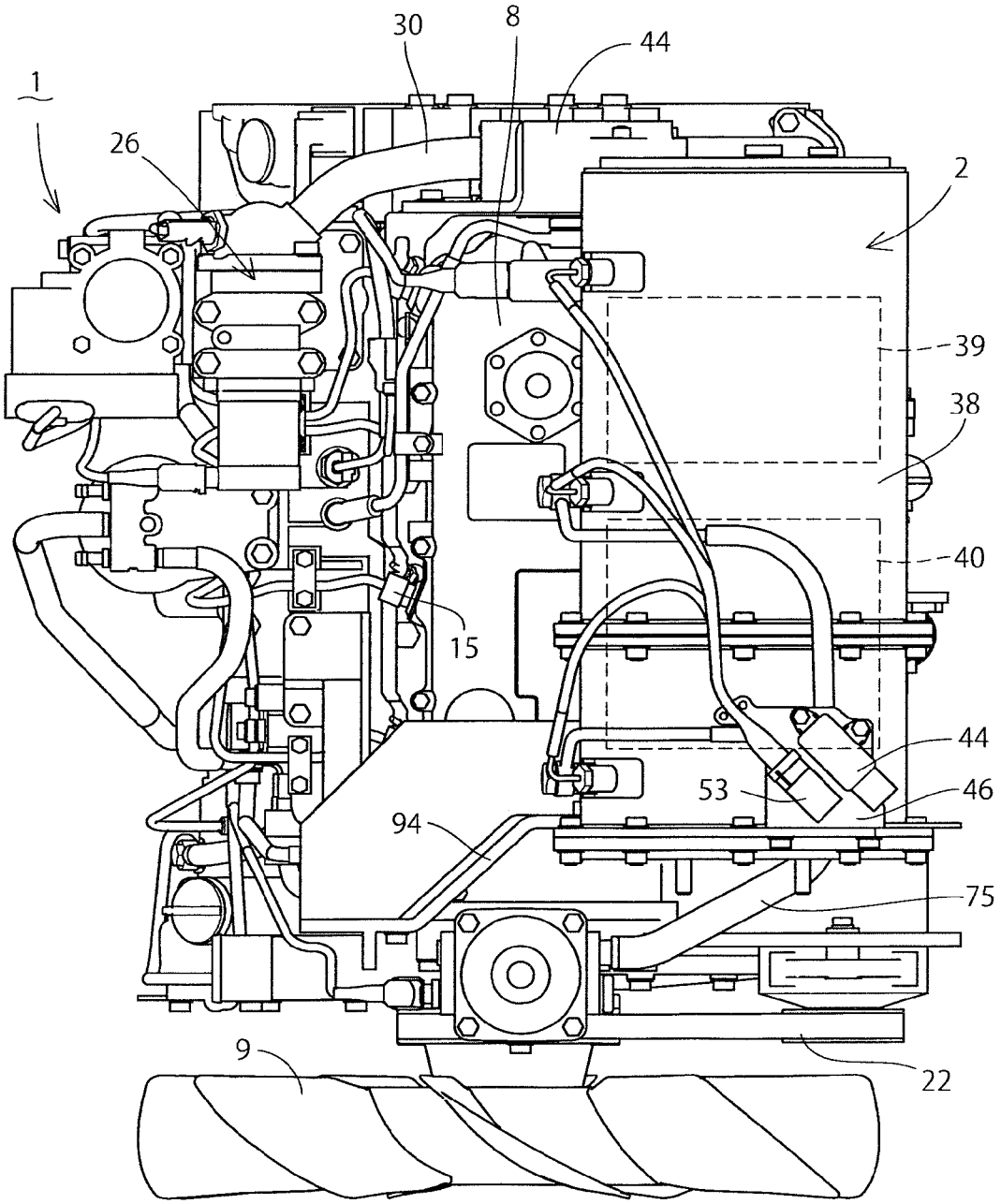
FIG. 5 is a plan view of the diesel engine.
Figure 6:
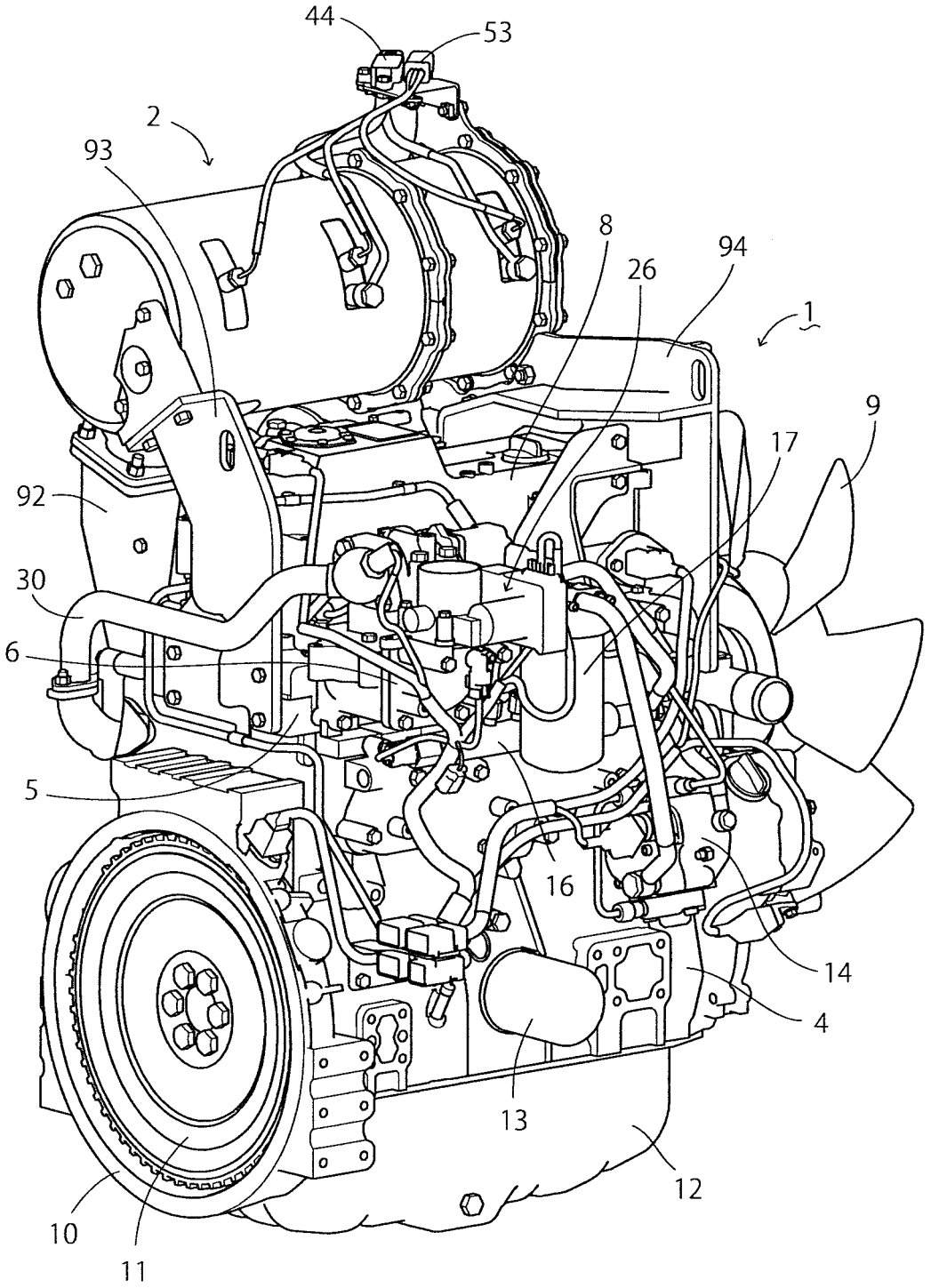
FIG. 6 is a perspective view, from the left, of the diesel engine.
Figure 7:
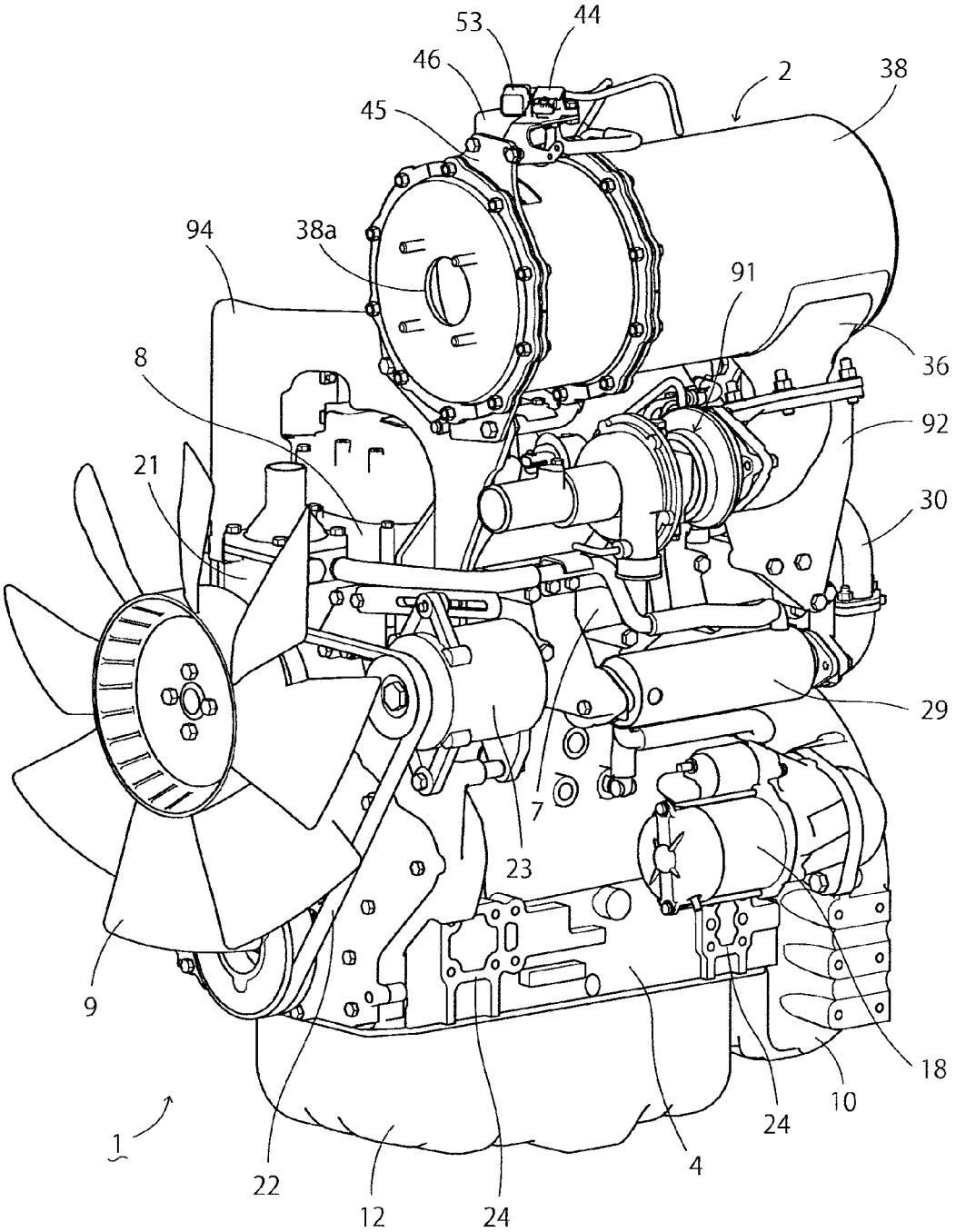
FIG. 7 is a perspective view, from the right, of the diesel engine.
Figure 8:
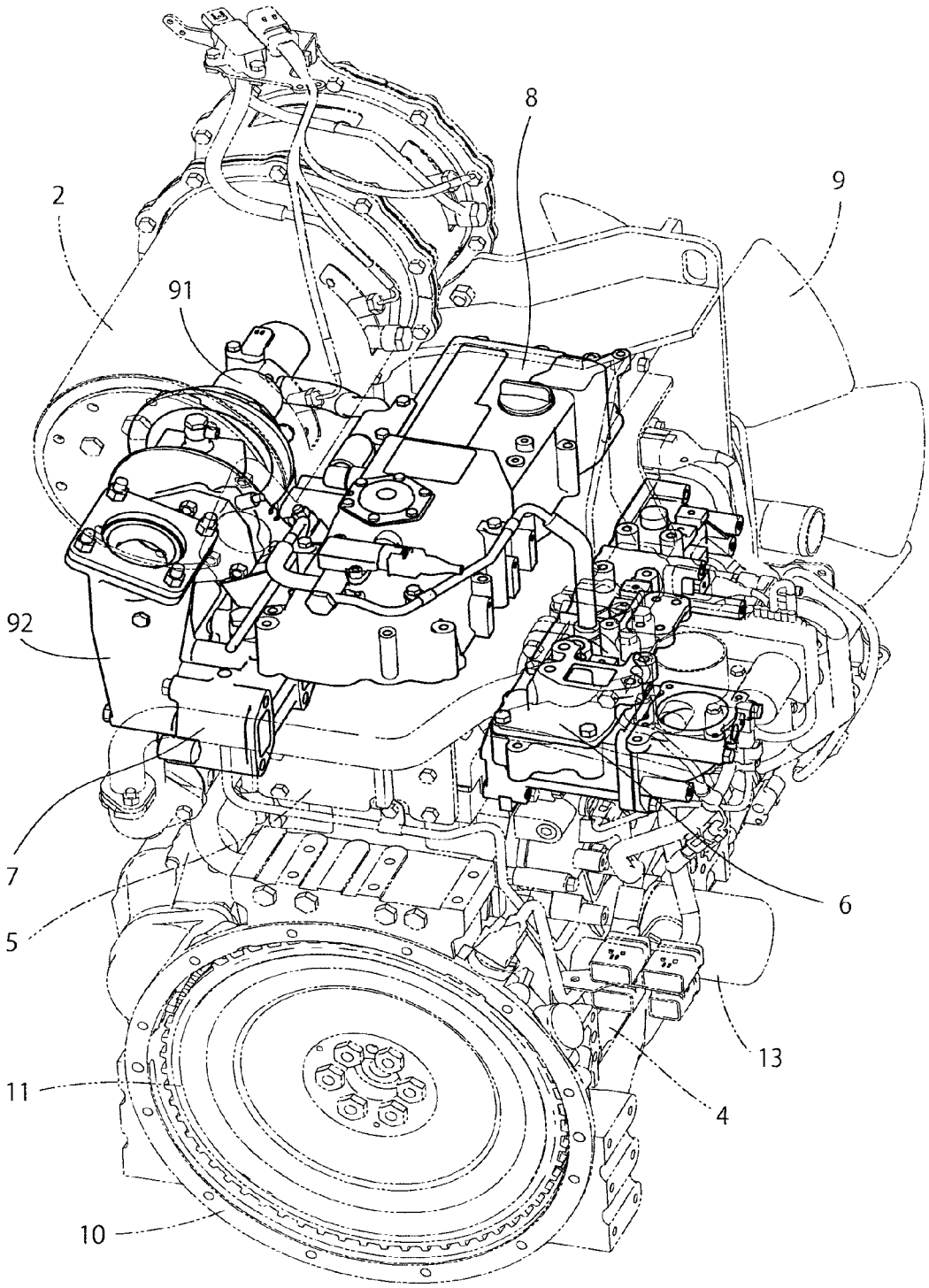
FIG. 8 is a perspective view, from the left, of the head cover portion.

An engine apparatus according to an embodiment of the present invention will be described below by referring to FIGS. 1 to 16. A diesel engine 1 is disposed as a prime mover in a construction machine, a civil engineering machine, an agricultural machine, or a cargo-handling machine. In the diesel engine 1, an exhaust gas purifier 2 (diesel particulate filter) of continuous regeneration type is disposed. The exhaust gas purifier 2 removes particulate matter (PM) contained in exhaust gas of the diesel engine 1, and in addition, reduces carbon monoxide (CO) and hydrocarbon (HC) contained in the exhaust gas of the diesel engine 1.

The diesel engine 1 includes a cylinder block 4, which includes an engine output crank shaft 3 and a piston (not shown). Over the cylinder block 4, a cylinder head 5 is disposed. On a right side surface of the cylinder head 5, an intake manifold 6 is disposed. On a left side surface of the cylinder head 5, an exhaust manifold 7 is disposed. On a top side surface of the cylinder head 5, a head cover 8 is disposed. On a front side surface of the cylinder block 4, a cooling fan 9 is disposed. On a rear side surface of the cylinder block 4, a flywheel housing 10 is disposed. In the flywheel housing 10, a flywheel 11 is disposed.

The flywheel 11 is axially supported on the crank shaft 3 (engine output shaft). The power of the diesel engine 1 is retrieved to an operation unit of a working vehicle (such as a backhoe and a forklift) through the crank shaft 3. On a lower surface of the cylinder block 4, an oil pan 12 is disposed. Lubricant in the oil, pan 12 is supplied to lubrication parts of the diesel engine 1 through an oil filter 13, which is disposed on a side surface of the cylinder block 4.

On the side surface of the cylinder block 4 that is above the oil filter 13 (below the intake manifold 6), a fuel supply pump 14 is mounted. Through the fuel supply pump 14, fuel is supplied. The diesel engine 1 is provided with injectors 15 for four cylinders. The injectors 15 each have a fuel injection valve (not shown) of electromagnetic on-off control type. Through the fuel supply pump 14, a hollow cylindrical common rail 16, and a fuel filter 17, the injectors 15 are each connected with a fuel tank (not shown) disposed in the working vehicle.

The fuel in the fuel tank is sent under pressure from the fuel supply pump 14 to the common rail 16 through the fuel filter 17, so that the fuel is stored in the common rail 16 under high pressure. The fuel injection valve of each of the injectors 15 is on-off controlled so that the injectors 15 inject the high pressure fuel in the common rail 16 to the cylinders of the diesel engine 1. In the flywheel housing 10, an engine starter 1 is disposed.

At a left side part on the front surface of the cylinder block 4, a cooling water pump 21 for cooling water lubrication is disposed. The cooling water pump 21 is coaxial to the fan axis of the cooling fan 9. By the rotation of the crank shaft 3, the cooling fan 9 together with the cooling water pump 21 is driven through a cooling fan drive V belt 22. The working vehicle is provided with a radiator (not shown), which contains cooling water. By the driving of the cooling water pump 21, the cooling water is supplied to the cooling water pump 21. Then, the cooling water is supplied to the cylinder block 4 and the cylinder head 5, and thus the diesel engine 1 is cooled. On the left side of the cooling water pump 21, an alternator 23 is disposed.

On each of left and right side surfaces of the cylinder block 4, an engine leg mounting portion 24 is disposed. To each engine leg mounting portion 24, an engine leg (not shown) provided with a rubber vibration isolator is fastened using a bolt. Through each engine leg, the diesel engine 1 is supported on the working vehicle (on an engine mounting chassis of a backhoe, a fork lift, or another working vehicle) in a vibration preventing manner.

Further, an EGR device 26 (exhaust gas recirculation device) will be described. To an inlet of the intake manifold 6, which protrudes upward, an air cleaner (not shown) is coupled through the EGR device 26 (exhaust gas recirculation device). From the air cleaner, new air (external air) is sent to the intake manifold 6 through the EGR device 26.

The EGR device 26 includes: an EGR body casing (collector) (not shown), which mixes part of the exhaust gas (EGR gas from the exhaust manifold) from the diesel engine with new air (external air from the air cleaner), and supplies the resulting air to the intake manifold 6; an intake throttle member (not shown), which couples the EGR body casing 27 to the air cleaner; a recirculation exhaust gas pipe 30, which is coupled to the exhaust manifold 7 through an EGR cooler 29 to serve as a reflux pipe conduit; and an EGR valve member (not shown), which couples the EGR body casing to the recirculation exhaust gas pipe 30.

That is, the intake manifold 6 is coupled to the intake throttle member, which is for new air introduction, through the EGR body casing. To the EGR body casing, an exit end of the recirculation exhaust gas pipe 30, which extends from the exhaust manifold 7, is coupled. The EGR body casing is fastened using a bolt to the inlet of the intake manifold 6 in an attachable and detachable manner.

The exit end of the recirculation exhaust gas pipe 30 is coupled to the EGR device 26. An inlet side of the recirculation exhaust gas pipe 30 is coupled to the exhaust manifold 7 through the EGR cooler 29. By adjusting the opening degree of an EGR valve (not shown) in the EGR device 26, the amount of EGR gas supply to the EGR device 26 is adjusted.

The above-described configuration ensures that new air (external air) is supplied to the inside of the EGR device 26 from the air cleaner through the intake throttle member, while EGR gas (part of the exhaust gas discharged from the exhaust manifold) is supplied to the inside of the EGR device 26 from the exhaust manifold 7. The new air from the air cleaner and the EGR gas from the exhaust manifold 7 are mixed together in the EGR device 26, and then the mixture gas in the EGR device 26 is supplied to the intake manifold 6. That is, part of the exhaust gas discharged from the diesel engine 1 to the exhaust manifold 7 is made to flow back to the diesel engine 1 through the intake manifold 6. This decreases the maximum combustion temperature at the time of high-load driving, and reduces the amount of NOx (nitrogen oxide) exhaust from the diesel engine 1.

Next, the exhaust gas purifier 2 will be described. The exhaust gas purifier 2 includes an exhaust gas purification casing 38, which includes a purification inlet pipe 36. The exhaust gas purification casing 38 incorporates: a diesel oxidation catalyst 39 (gas purifier), which generates nitrogen dioxide (NO2) and is made of platinum or another material; and a soot filter 40 (gas purifier) of honeycomb structure, which continuously oxidizes and removes collected particulate matter (PM) at comparatively low temperature. The diesel oxidation catalyst 39 and the soot filter 40 are arranged in series in the direction of movement of the exhaust gas (from downward to upward in FIG. 1). To an exhaust gas exit 38*a* of the exhaust gas purification casing 38, a muffler is coupled through an exhaust pipe, not shown. Through the muffler, the exhaust gas is discharged to outside the engine.

The above-described configuration ensures that nitrogen dioxide (NO2) generated by oxidation effected by the diesel oxidation catalyst 39 is supplied to the inside of the soot filter 40 from one side end surface (intake side end surface). The particulate matter (PM) contained in the exhaust gas of the diesel engine 1 is collected by the soot filter 40, where the particulate matter (PM) is continuously oxidized and removed by the nitrogen dioxide (NO2). In addition to the removal of the particulate matter (PM) in the exhaust gas of the diesel engine 1, the content of carbon monoxide (CO) and the content of hydrocarbon (HC) in the exhaust gas of the diesel engine 1 are reduced.

An upstream-side gas temperature sensor 42 and a downstream-side gas temperature sensor 43, which are each in the form of a thermister, are attached to the exhaust gas purification casing 38. The upstream-side gas temperature sensor 42 detects an exhaust gas temperature at a gas inflow side end surface of the diesel oxidation catalyst 39. The downstream-side gas temperature sensor 43 detects an exhaust gas temperature at a gas outflow side end surface of the diesel oxidation catalyst. The sensors 42 and 43 convert the temperatures of the exhaust gas into electrical signals, which are output to an engine controller (not shown).

Further to the exhaust gas purification casing 38, a differential pressure sensor 44, which serves as an exhaust gas pressure sensor, is attached. The differential pressure sensor 44 detects a pressure difference in the exhaust gas between the upstream side and the downstream side of the soot filter 40. The pressure difference of the exhaust gas is converted into an electrical signal, which is output to the engine controller (not shown). Based on the exhaust pressure difference between the upstream side and the downstream side of the soot filter 40, the accumulated amount of the particulate matter in the soot filter 40 is calculated, and this provides a grasp of the state of clogging in the soot filter 40.

Figure 11:
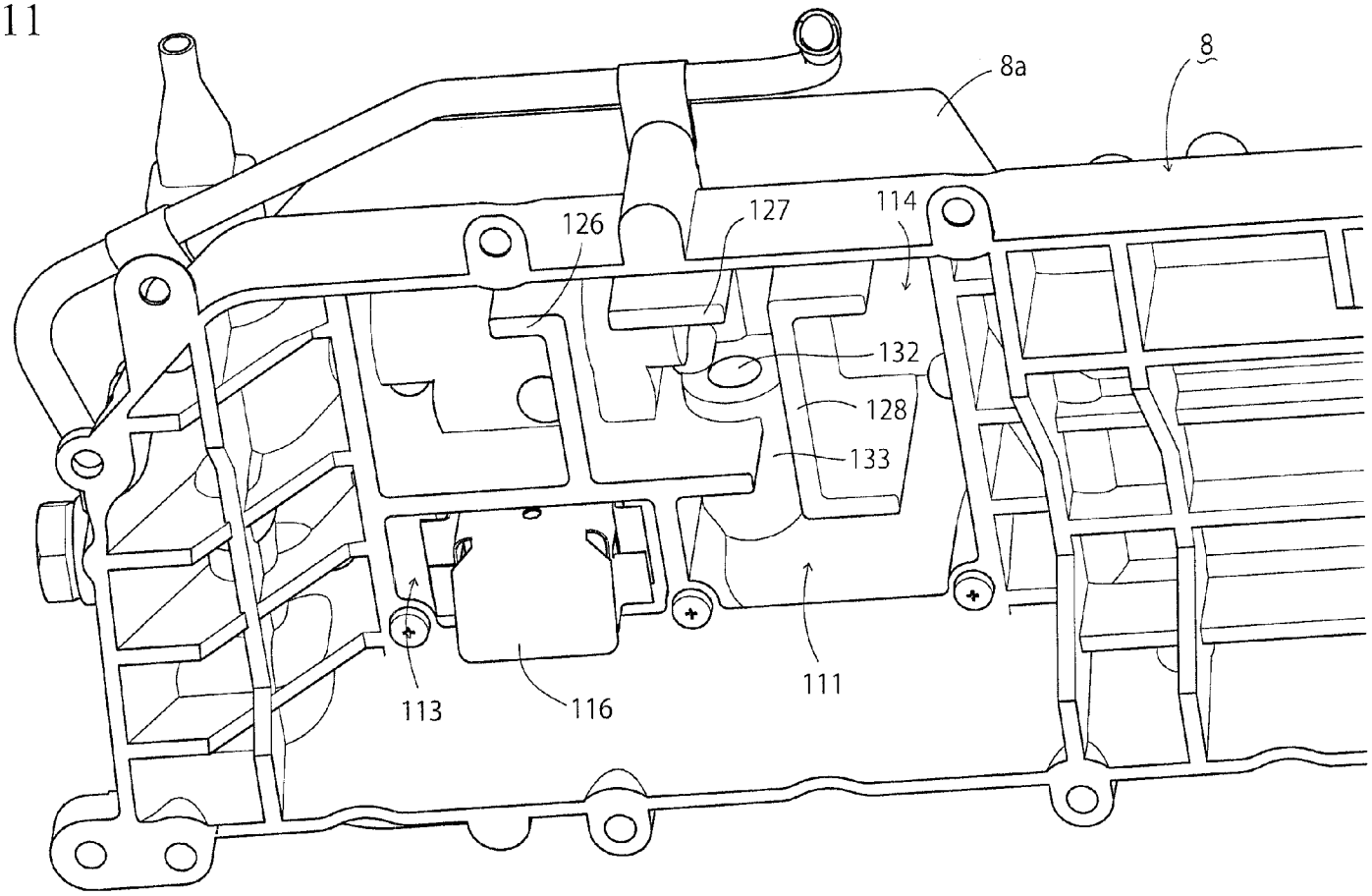
FIG. 11 is partially enlarged perspective view, from the bottom, of the head cover.

As shown in FIGS. 1 and 11, a sensor bracket 46 is fastened to an exit holding flange 45 of the exhaust gas purification casing 38 using a bolt, and thus the sensor bracket 46 is disposed on an outer surface side of the exhaust gas purification casing 38. To the sensor bracket 46, the differential pressure sensor 44, which includes an integral electrical wiring connector, is mounted. On the outer side surface of the exhaust gas purification casing 38, the differential pressure sensor 44 is disposed. To the differential pressure sensor 44, one end side of an upstream-side sensor piping 47 and one end side of a downstream-side sensor piping 48 are coupled. Sensor piping boss bodies 49 and 50, which are respectively on the upstream side and the downstream side, are disposed on the exhaust gas purification casing 38 as if to hold the soot filter 40 in the exhaust gas purification casing 38 between the sensor piping boss bodies 49 and 50. Another end side of the upstream-side sensor piping 47 and another end side of the downstream-side sensor piping 48 are respectively coupled to the sensor piping boss bodies 49 and 50.

The above-described configuration ensures that a difference (differential pressure of the exhaust gas) between the exhaust gas pressure at the inflow side of the soot filter 40 and the exhaust gas pressure at the outflow side of the soot filter 40 is detected through the differential pressure sensor 44. The residual amount of the particulate matter in the exhaust gas collected by the soot filter 40 is proportional to the differential pressure of the exhaust gas. In view of this, when the amount of the particulate matter residual in the soot filter 40 increases to or over a predetermined amount, regeneration control (for example, control to raise the exhaust temperature) is executed to reduce the amount of the particulate matter in the soot filter 40 based on a result of the detection by the differential pressure sensor 44. When the amount of the particulate matter residual further increases to or over a regeneration controllable range, the exhaust gas purification casing 38 may be detached and disassembled to conduct manual maintenance of cleaning the soot filter 40 and removing the particulate matter.

An electrical wiring connector 53 of the upstream-side gas temperature sensor 42 and the downstream-side gas temperature sensor 43 is fixed to the sensor bracket 46. The electrical wiring connector of the differential pressure sensor 44 and the electrical wiring connector 53 of the upstream-side gas temperature sensor 42 and the downstream-side gas temperature sensor 43 are supported with these electrical wiring connectors being in such postures that the electrical wiring connectors are oriented in the same connection direction.

Next, a structure in which the exhaust gas purifier 2 is attached to the diesel engine 1 will be described. The exhaust manifold 7 is provided with a turbocharger 91. To the exhaust manifold 7 and the turbocharger 91, the housing support 92 is fastened using a bolt. The mounting position of the exhaust gas purifier 2 in the front-rear directions relative to the housing support 92 is adjustable frontward and rearward. Through a hollow portion of the housing support 92, the exhaust gas of the diesel engine 1 is supplied from the exhaust manifold 7 to the exhaust gas purifier 2.

Further, an inlet side bracket 93 and an exit side bracket 94 are disposed. The exhaust gas purifier 2 has an exhaust gas movement direction that is parallel to a crank shaft 3 axis line (output shaft axis line) of the diesel engine 1. The inlet side bracket 93 and the exit side bracket 94 each have a form of a plate that is wide in a direction crossing the crank shaft 3 axis line.

To a front surface of the cylinder head 5, a furcated lower end of the exit side bracket 94 is fastened using a bolt. To a rear surface of the cylinder head 5, a lower end of the inlet side bracket 93 is fastened using a bolt. On the two, front and rear surfaces of the cylinder head 5, the exit side bracket 94 and the inlet side bracket 93 are disposed upright. The exit side bracket 94 and the inlet side bracket 93 ensure that the cylinder head 5 of the diesel engine 1 supports a gas purification housing 60 at its exhaust gas inlet side and exhaust gas exit side.

Next, by referring to FIGS. 8 to 16, description will be made with regard to a structure of the blow-by gas returning device, in which a leakage of blow-by gas from the combustion chamber of the diesel engine 1 is returned to the intake system. The head cover 8 covers an intake valve, an exhaust valve (which are not shown), and other elements disposed on a top surface of the cylinder head 5. A blow-by gas returning device 111 is disposed on the head cover 8. The blow-by gas returning device 111 includes a gas pressure regulation valve 112, which is disposed on a top surface of the head cover 8.

Also a gas pressure regulation portion 8*a* is disposed as an upward projection part of a top surface of the head cover 8. In the gas pressure regulation portion 8*a*, a blow-by gas intake chamber 113 and a blow-by gas expansion chamber 114 are disposed. The blow-by gas intake chamber 113 takes in blow-by gas that has been leaked from the combustion chamber and other elements of the diesel engine 1 toward the top surface of the cylinder head 5. The blow-by gas expansion chamber 114 receives a supply of the blow-by gas in the blow-by gas intake chamber 113 through the gas pressure regulation valve 112. In the gas pressure regulation portion 8*a*, a shield plate 115 is secured to the bottom of the gas pressure regulation portion 8*a* using screws 117. On the top surface of the head cover 8, the blow-by gas intake chamber 113 and the blow-by gas expansion chamber 114 are shielded from each other at their bottom surfaces by the shield plate 115.

The blow-by gas intake chamber 113 has a bottom surface side opening through which the blow-by gas is introduced from the top surface side of the head cover 8. At the bottom surface side opening, a guide 116, a filtration net 118, and a filtration net support 119 are disposed. The guide 116 prevents lubricant from entering from the cylinder head 5 side. The filtration net 118 catches mist lubricant contained in the blow-by gas and is made of steel wool or another material. The filtration net support 119 is disposed over a top surface of the shield plate 115 (inside the blow-by gas intake chamber 113) to support the filtration net 118. While the guide 115 is closing the bottom surface side opening of the blow-by gas intake chamber 113 to prevent liquid lubricant from entering the blow-by gas intake chamber 113 directly from the cylinder head 5 side, a leakage of blow-by gas on top surface side of the head cover 8 is introduced to the blow-by gas intake chamber 113 through the filtration net 118.

The gas pressure regulation valve 112 includes; a valve casing 121, which defines a pressure control chamber 120 on a top surface of the gas pressure regulation portion 8*a*; and a pressure control diaphragm 122, which is disposed in the pressure control chamber 120. In the gas pressure regulation portion 8*a*, an inlet conduit 123 and an exit conduit 124 are disposed. The inlet conduit 123 couples the pressure control chamber 120 to the top surface side of the blow-by gas intake chamber 113. The exit conduit 124 couples the blow-by gas expansion chamber 114 to the pressure control chamber 120. From the blow-by gas intake chamber 113, the blow-by gas is introduced to the blow-by gas expansion chamber 114 through the inlet conduit 123, a valve 125 of the diaphragm 122, and the exit conduit 124.

In the blow-by gas expansion chamber 114, a plurality of maze conduits 129, 130, and 131 are disposed. The plurality of maze conduits 129, 130, and 131 are defined by a plurality of partition walls 126, 127, and 128. Upper side ends of the plurality of partition walls 126, 127, and 128 are integrally coupled to a top surface of the blow-by gas expansion chamber 114. The plurality of partition walls 126, 127, and 128 are integrally formed on the head cover 8. The plurality of partition walls 126, 127, and 128 have wall surfaces disposed in the head cover 8 to implement a structure in which those wall surfaces of the plurality of partition walls 126, 127, and 128 that are wide in the front-rear direction of the diesel engine 1 prevent accumulation of lubricant in the center portion of the diesel engine 1, where the exit conduit 124 is positioned, when the diesel engine 1 is inclined in a right-left direction. The blow-by gas introduced to the blow-by gas expansion chamber 114 through the exit conduit 124 expands into the plurality of maze conduits 129, 130, and 131. By allowing the blow-by gas to expand through the exit conduit 124 into the blow-by gas expansion chamber 114, lubricant components in the blow-by gas are removed through the plurality of maze conduits 129, 130, and 131.

Further, a blow-by gas exit 132 communicates with the inside of the blow-by gas expansion chamber 114. The blow-by gas exit 132 is disposed at an inner side end of a cylindrical exit 133, which is integral with the head cover 8. To an outer side end of the cylindrical exit 133, one end side of a returning hose 135 is coupled through a joint 134. To another end side of the returning hose 135, one end side of a returning pipe 136 is coupled. Through another end side of the returning pipe 136, the blow-by gas exit 132 is coupled to an intake portion of the turbocharger 91. The blow-by gas with the lubricant components removed in the blow-by gas expansion chamber 114 is returned to the intake manifold 6 through the turbocharger 91. The returning pipe 136 is fixed to the head cover 8 by a pipe support 137.

The blow-by gas exit 132 is disposed adjacent to the center of the right-left width of the portion of the head cover 8 where the blow-by gas expansion chamber 114 is disposed. For example, the diesel engine 1 in motion may be inclined in the right-left direction in such a state that the lubricant components removed from the blow-by gas in the blow-by gas expansion chamber 114 are accumulated on the bottom of the blow-by gas expansion chamber 114. In this case, the lubricant components are collected to the right side or left side of the bottom of the blow-by gas expansion chamber 114. This, as a result, makes it difficult for the lubricant components on the bottom of the blow-by gas expansion chamber 114 to flow into the blow-by gas exit 132. Since the wall surfaces of the partition walls 126, 127, and 128 are wide in the front-rear direction of the diesel engine 1, even though the diesel engine 1 is inclined in the right-left direction, the lubricant is prevented from accumulating adjacent to the center where the exit conduit 124 is positioned.

Meanwhile, in the vicinity of an approximate center of the shield plate 115, a lubricant returning hole 141 is open. On a lower surface side of the shield plate 115, one end side of a long, thin, tongue piece-shaped plate spring 142 is secured using a screw 143. Another end side of the plate spring 142 is operable and closable over a lower surface side opening of the lubricant returning hole 141. That is, the lubricant returning hole 141, which is a lubricant exit to return the lubricant isolated in the blow-by gas expansion chamber 114 to the inside of the diesel engine 1, is disposed on the shield plate 115, which constitutes the bottom of the blow-by gas expansion chamber 114. Over the lubricant returning hole 141 of the blow-by gas expansion chamber 114, the plate spring 142 is disposed in an openable and closable manner to serve as a non-return valve.

The above-described configuration ensures that when the lubricant components removed from the blow-by gas in the blow-by gas expansion chamber 114 are accumulated on the top surface side of the shield plate 115, the plate spring 142 opens by the weight of the lubricant components, and the lubricant components fall downward through the lubricant returning hole 141 onto the top surface side of the cylinder head 5 to be collected into the diesel engine 1. Even though, for example, the lubricant may scatter from the top surface side of the cylinder head 5 toward the lubricant returning hole 141, the scattering lubricant closes the plate spring 142. Thus, the scattering lubricant is prevented from entering the blow-by gas expansion chamber 114 through the lubricant returning hole 141.

As shown in FIGS. 9 to 16, in the engine apparatus provided with the blow-by gas returning device 111, which returns a leakage of blow-by gas from the combustion chamber to the intake system, the blow-by gas expansion chamber 114 is provided to introduce the blow-by gas through the gas pressure regulation valve 112. Lubricant contained in the blow-by gas is isolated in the blow-by gas expansion chamber 114, and the blow-by gas is returned to the intake side of the diesel engine 1 from the blow-by gas expansion chamber 114. Thus, by taking the blow-by gas into the blow-by gas expansion chamber 114 through the gas pressure regulation valve 112, mist lubricant contained in the blow-by gas liquefies in the blow-by gas expansion chamber 114 and thus is removed. The gas pressure regulation valve 112 is utilized not only for pressure adjustment but also for removal of lubricant, which eliminates the need for a filtration net. The blow-by gas returning structure is simplified, and it is not necessary to install a mist separator. In the diesel engine 1, in which the exhaust gas purifier 2 (diesel particulate filter) is installed, the exhaust gas purifier 2 is less likely to suffer from catalyst degradation and clogging, resulting in improved fuel efficiency.

Figure 9:
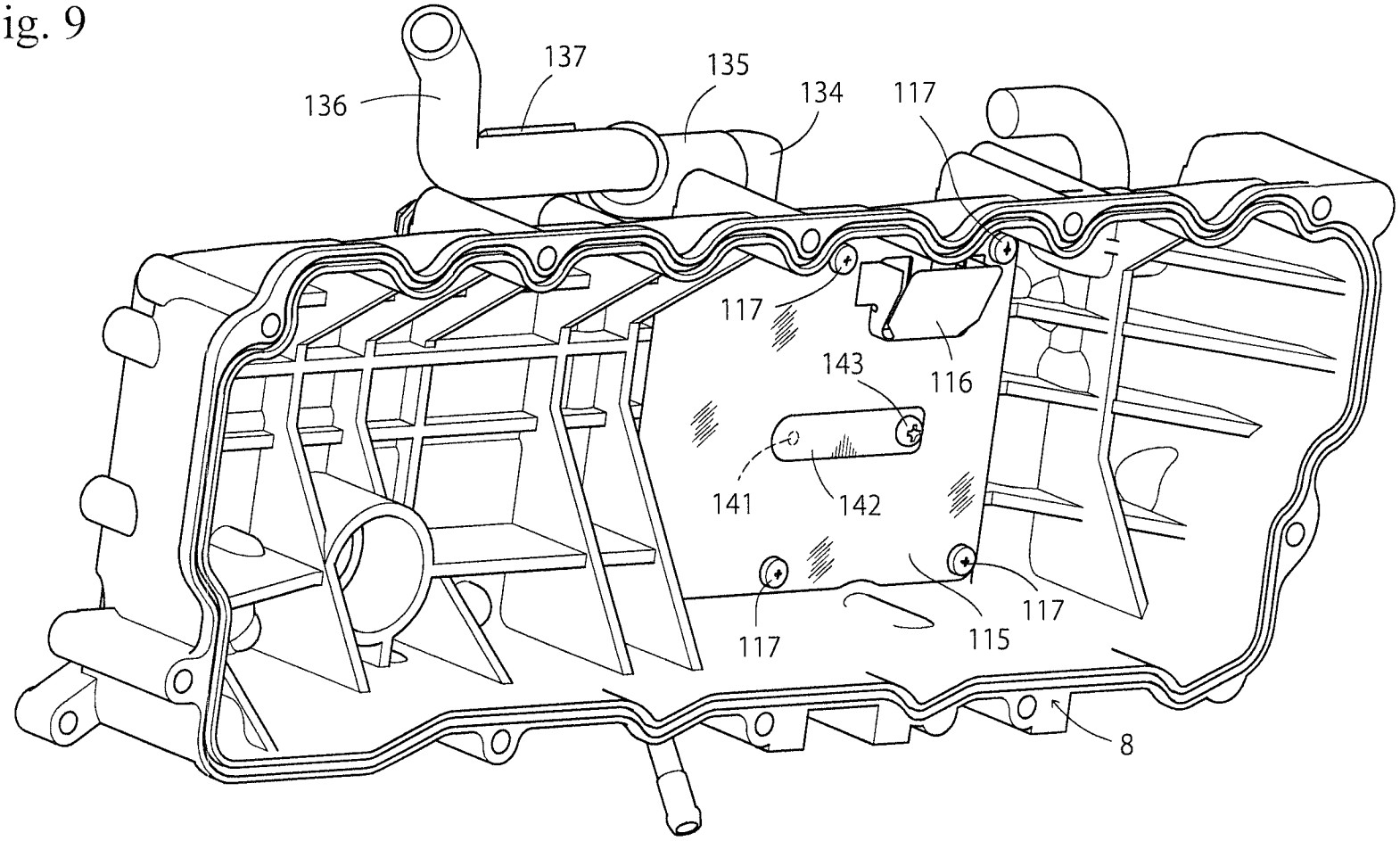
FIG. 9 is a perspective view, from the bottom, of a head cover.
Figure 10:
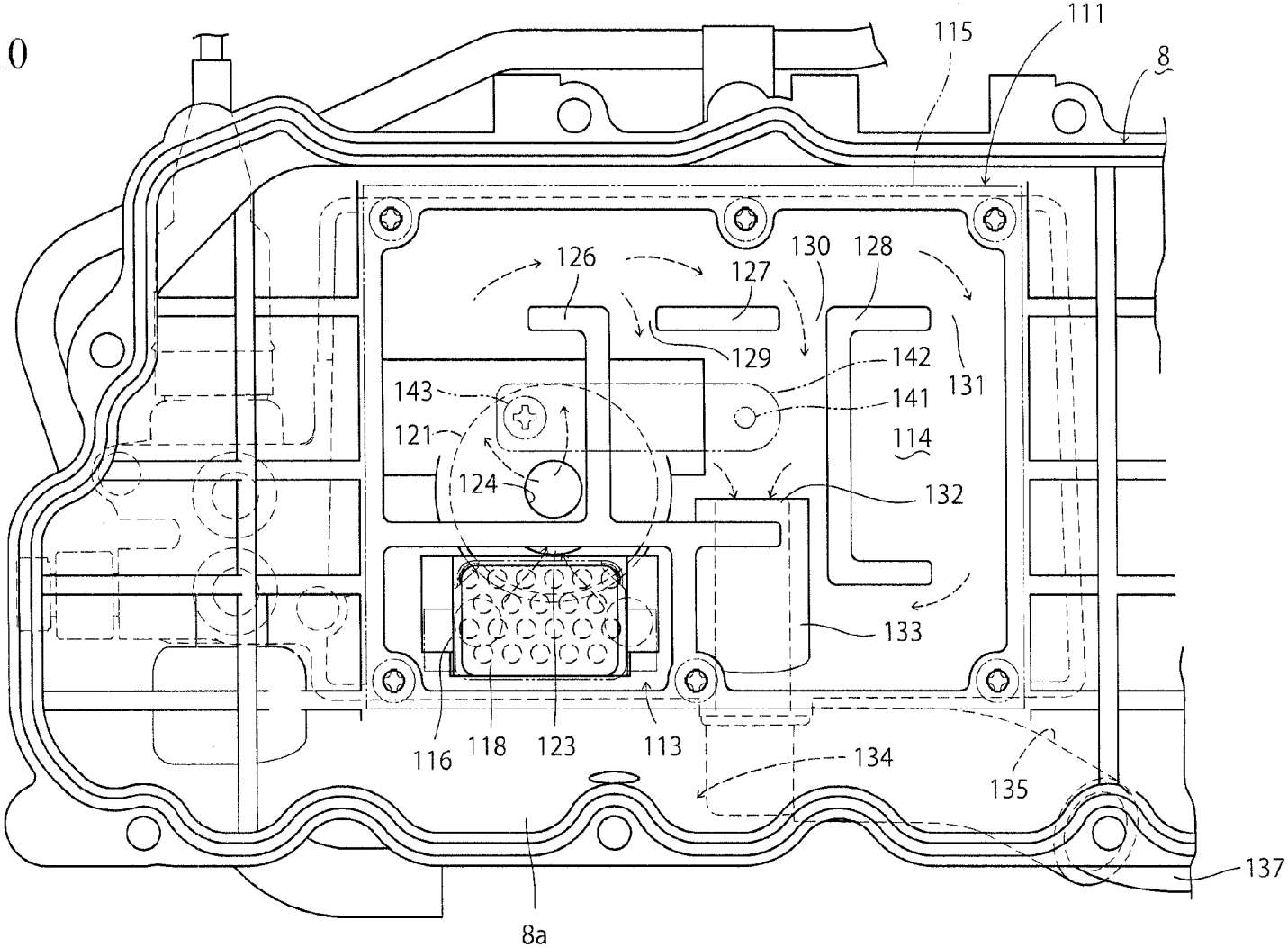
FIG. 10 is a partially enlarged bottom view of the head cover.
Figure 16:
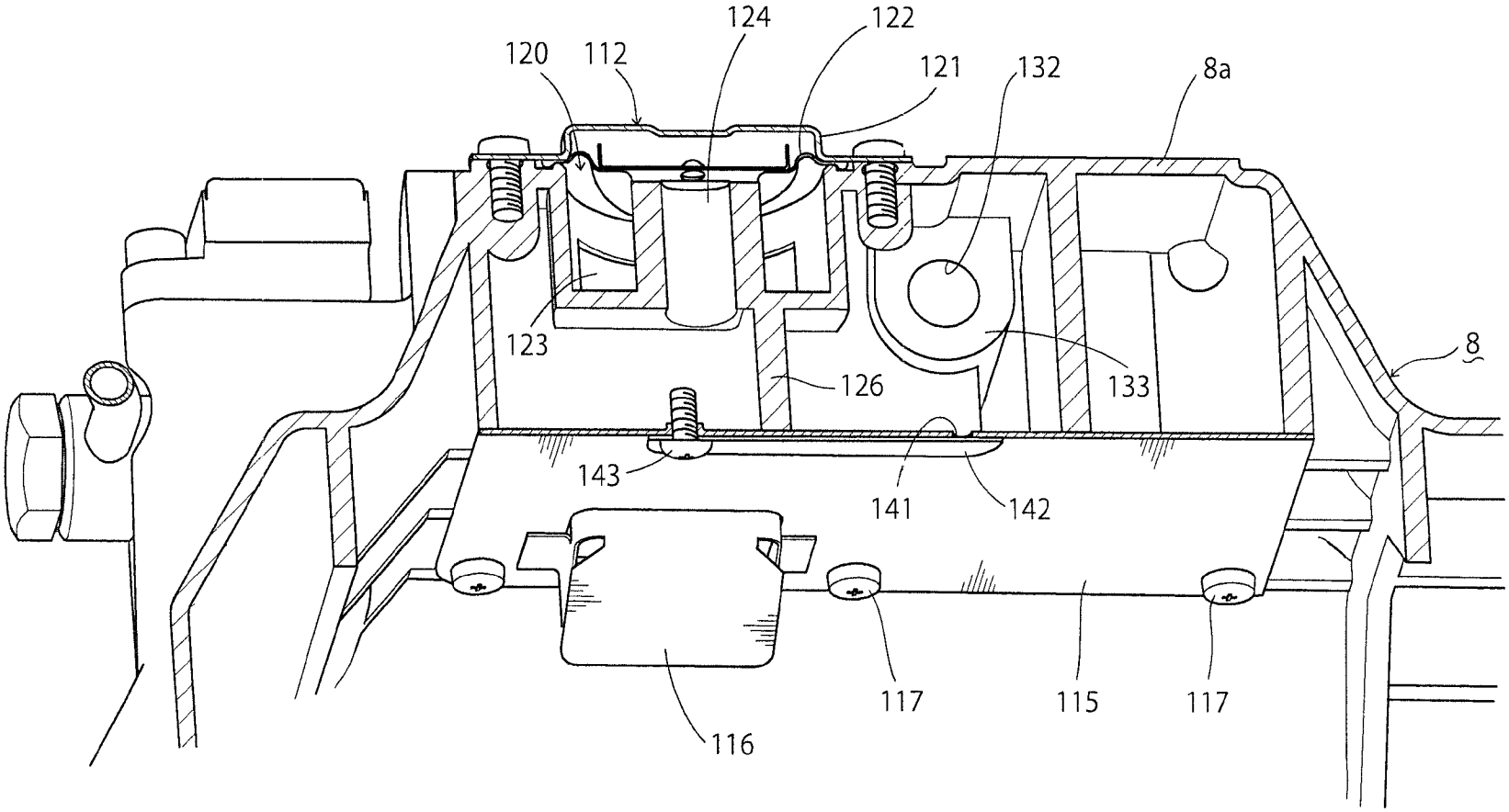
FIG. 16 is a partially cross-sectional perspective view, from the bottom, of the head cover.

The structure shown in FIGS. 9, 10, and 16 is provided with the lubricant returning hole 141, through which the lubricant isolated in the blow-by gas expansion chamber 114 is returned to the inside of the diesel engine 1. In this structure, the plate spring 142 in the form of a non-return valve is openable and closable over the lubricant returning hole 141 of the blow-by gas expansion chamber 114. This facilitates the return of the lubricant collected in the blow-by gas expansion chamber 114 to the diesel engine 1 side while preventing the lubricant from being injected from the diesel engine 1 side toward the blow-by gas expansion chamber 114. For example, the blow-by gas expansion chamber 114, which has a hermetically sealed structure, is readily provided on the head cover 8 with reduced piece-part count.

Figure 12:
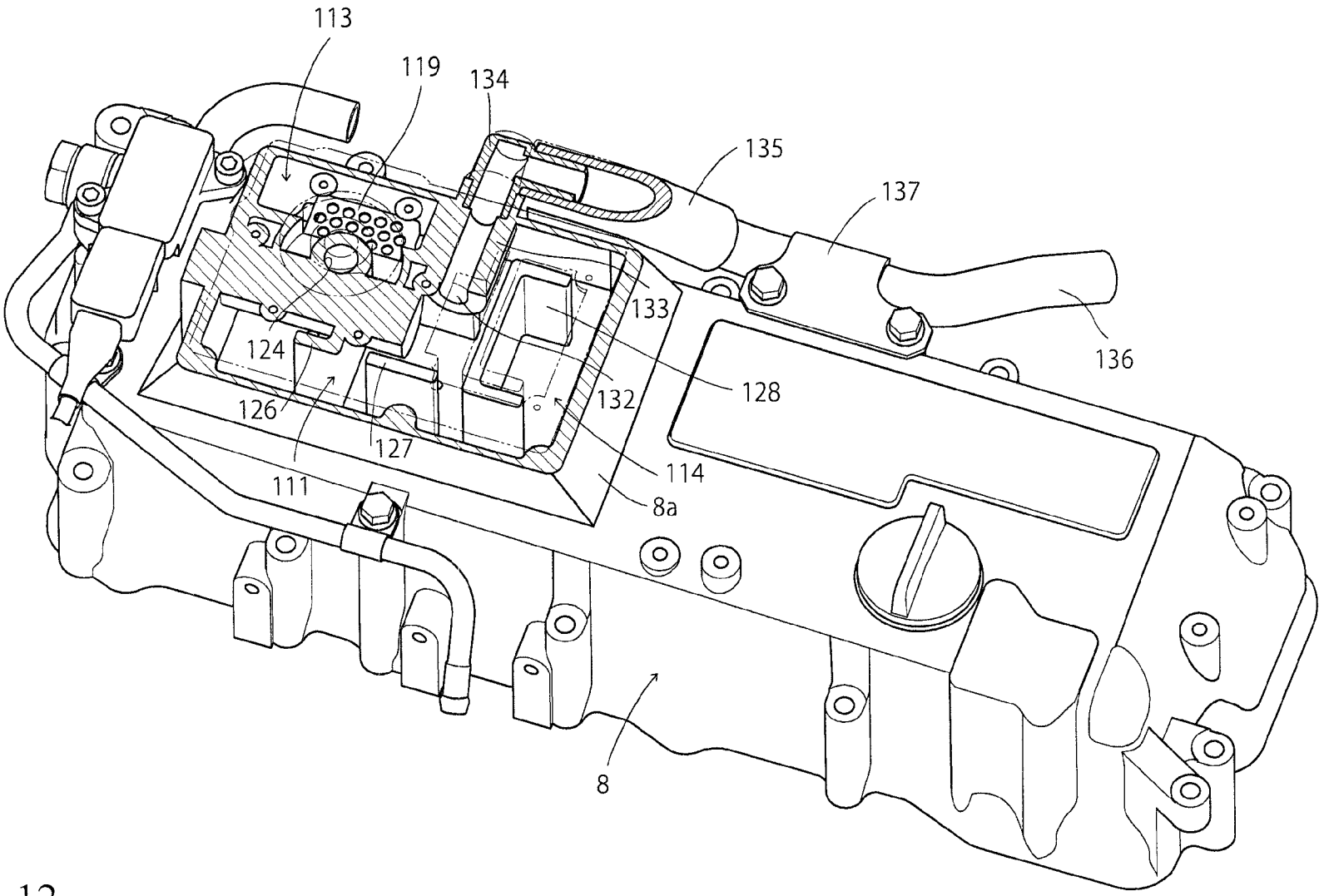
FIG. 12 is a partially cross-sectional perspective view, from the top, of the head cover.
Figure 13:
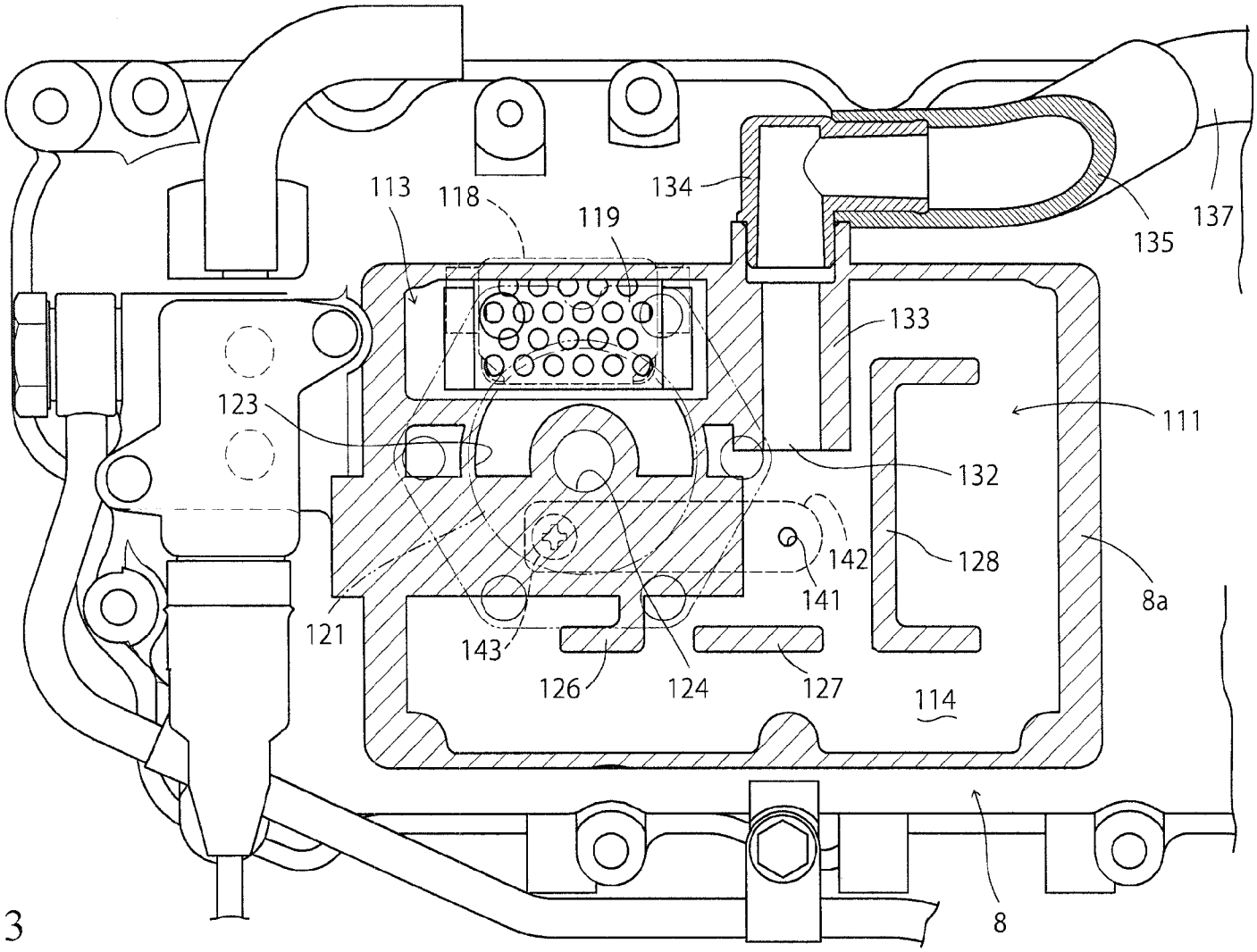
FIG. 13 is a partially enlarged plan view of the head cover.
Figure 14:
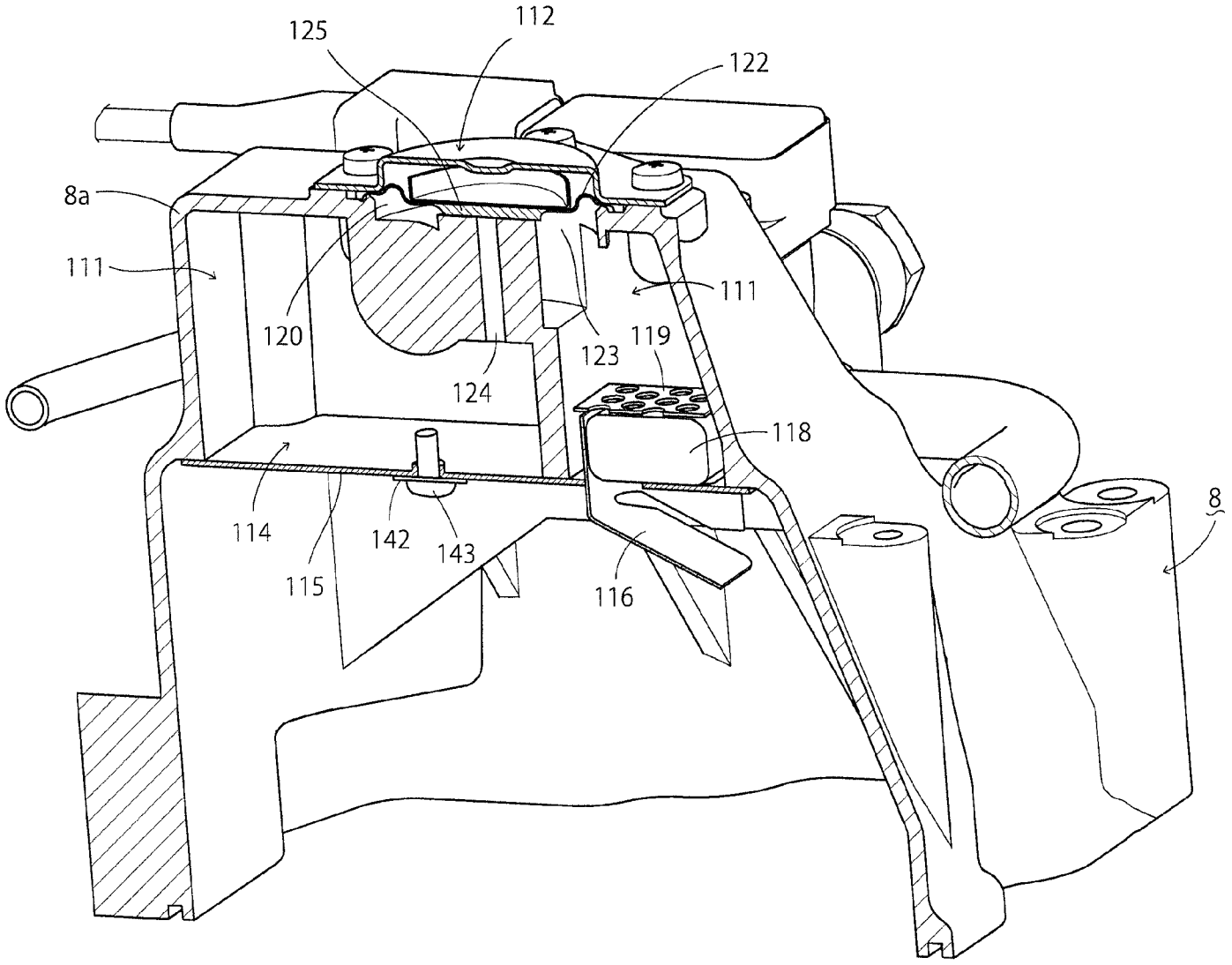
FIG. 14 is a cross-sectional perspective view of the head cover.
Figure 15:
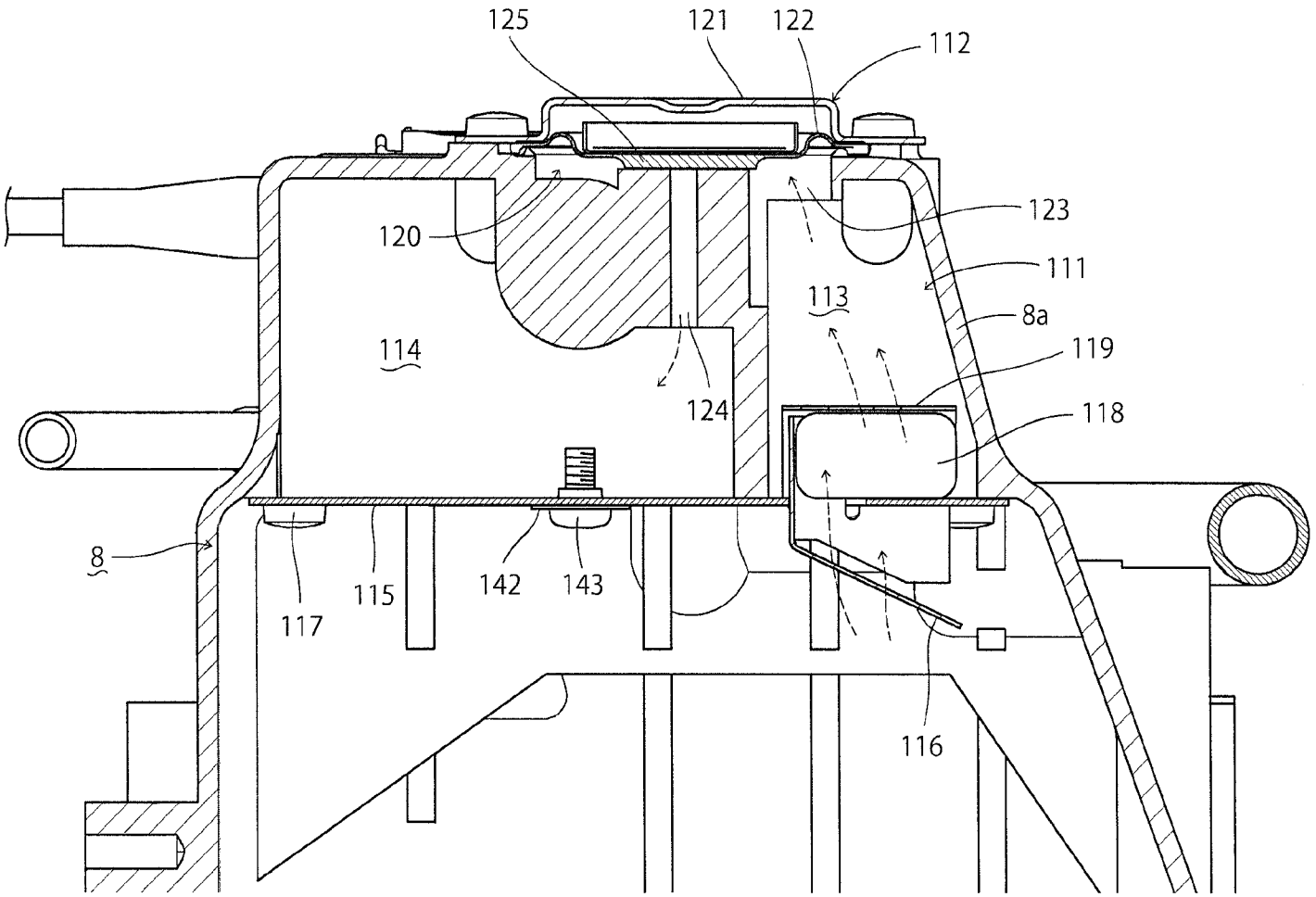
FIG. 15 is a cross-sectional side view of the head cover.

The structure shown in FIGS. 10, 12, and 13 is such that the blow-by gas is returned from the blow-by gas expansion chamber 114 to the intake side of the diesel engine 1 through the blow-by gas exit 132. The blow-by gas exit 132 is disposed adjacent to the center of the right-left width of the portion of the head cover 8 where the blow-by gas expansion chamber 114 is disposed. This ensures that the blow-by gas exit 132 is any time kept at a distance from the surface of the lubricant isolated in the blow-by gas expansion chamber 114 even when the diesel engine 1 is inclined in any of the left and right directions to increase the height of the surface of the lubricant. The lubricant collected in the blow-by gas expansion chamber 114 is readily prevented from flowing into the blow-by gas exit 132.

DESCRIPTION OF THE REFERENCE NUMERALS

1 Diesel engine
8 Head cover
111 Blow-by gas returning device
112 Gas pressure regulation valve
114 Blow-by gas expansion chamber
132 Blow-by gas exit
141 Lubricant return hole
142 Plate spring

The invention claimed is:

1. An engine apparatus comprising:

an engine;

a blow-by gas returning device configured to return a leakage of blow-by gas from a combustion chamber to an intake system;

in a head cover disposed in an upper surface of a cylinder head of the engine, an expansion chamber into which the blow-by gas is introduced through a gas pressure regulation valve, in which expansion chamber lubricant contained in the blow-by gas is isolated, and from which expansion chamber the blow-by gas is returned through a blow-by gas exit to an intake side of the engine;

an exit conduit of the gas pressure regulation valve disposed inside the head cover, adjacent to a center of right-left width of a portion of the head cover and connected above the expansion chamber;

a plurality of maze conduits defined by a plurality of partition walls, which are disposed in the expansion chamber; and wherein the blow-by gas exit is adjacent to the center of the right-left width of the portion of the head cover where the expansion chamber is disposed, so as to return the blow-by gas from the expansion chamber to the intake side of the engine through the blow-by gas exit, the partition walls being sufficiently wide in a front-rear direction of the engine apparatus to partition off the exit conduit of the gas pressure regulation valve and the blow-by gas exit from each other; and further comprising:

a shielding plate closing off a bottom of the expansion chamber;

a lubricant return opening provided in the shield plate to return the lubricant separated in the expansion chamber into the engine;

a plate spring secured to a lower surface of the shield plate and overlying the lubricant return opening and openable and closable to function as a non-return valve; and wherein the lubricant return opening opens into one of the plurality of maze conduits positioned nearest the blow-by gas exit.

* * * * *